US012036439B2

(12) United States Patent
Gomes

(10) Patent No.: US 12,036,439 B2
(45) Date of Patent: Jul. 16, 2024

(54) BAR AND HAND GRIPS KIT FOR EXERCISE EQUIPMENT

(71) Applicant: Victor Gomes, Blaine, WA (US)

(72) Inventor: Victor Gomes, Blaine, WA (US)

( * ) Notice: Subject to any disclaimer, the term of this patent is extended or adjusted under 35 U.S.C. 154(b) by 184 days.

(21) Appl. No.: 17/730,318

(22) Filed: Apr. 27, 2022

(65) Prior Publication Data

US 2022/0347518 A1 Nov. 3, 2022

Related U.S. Application Data

(60) Provisional application No. 63/182,010, filed on Apr. 30, 2021.

(51) Int. Cl.
*A63B 21/00* (2006.01)

(52) U.S. Cl.
CPC ..... *A63B 21/4049* (2015.10); *A63B 21/4035* (2015.10); *A63B 2225/09* (2013.01)

(58) Field of Classification Search
CPC ..... A63B 21/4033; A63B 21/4035; A63B 21/4047; A63B 21/4049; A63B 21/1627
See application file for complete search history.

(56) References Cited

U.S. PATENT DOCUMENTS

| | | | | |
|---|---|---|---|---|
| 4,822,035 | A * | 4/1989 | Jennings | A63B 21/0724 482/106 |
| 7,066,866 | B1 * | 6/2006 | Mobley | A63B 1/00 482/40 |
| 9,278,247 | B2 * | 3/2016 | Kristiansen | A63B 23/1209 |
| 10,695,604 | B2 * | 6/2020 | Porterfield | A63B 21/4049 |
| 10,888,731 | B2 * | 1/2021 | Olmstead | A63B 21/0724 |
| 10,888,732 | B2 * | 1/2021 | Miller | A63B 21/4043 |
| 2004/0082448 | A1 * | 4/2004 | Martin | A63B 21/4017 482/139 |
| 2012/0152055 | A1 * | 6/2012 | Lechuga Priego | B62D 1/043 74/557 |
| 2018/0243605 | A1 * | 8/2018 | Light | A63B 21/072 |
| 2019/0126092 | A1 * | 5/2019 | Miller | A63B 21/4035 |
| 2020/0188724 | A1 * | 6/2020 | Bauerle | A63B 21/4049 |

* cited by examiner

*Primary Examiner* — Zachary T Moore
(74) *Attorney, Agent, or Firm* — FisherBroyles, LLP; Susan M. Oiler

(57) ABSTRACT

A kit has an elongate bar connectable to a cable of a pulley cable exercise machine, left hand grip, right hand grip, and a plurality of fasteners that make the left and right hand grips repeatedly, removably attachable to the bar. The bar has a plurality of elongate slots and a plurality of bores, each oriented transverse to a respective slot. Each of the left and right hand grips are freely rotatable in two dimensions and has a connector pivot shaped to be received in any of the slots with a second eyelet aligned with a respective one of the bores. When assembled, a fastener is received in the bore having the second eyelet of the left hand grip and in the bore having the second eyelet of the right hand grip. Each fastener defines a pivot point about which the respective hand grip pivots within the respective slot.

13 Claims, 5 Drawing Sheets

BAR AND HAND GRIPS KIT FOR EXERCISE EQUIPMENT

RELATED APPLICATIONS

This application claims the benefit of U.S. Provisional Application No. 63/182,010, filed Apr. 30, 2021, the entirety of which is incorporated by reference herein.

TECHNICAL FIELD

This application relates to bar and hand grips kits for exercise equipment, more particularly, to a kit for cable pulley exercise machines that has a bar with a plurality of slots for receiving a left hand grip and a right hand grip in a plurality of positions relative thereto, wherein both of the left and right hand grips are rotatable in two planes and are pivotable relative to the attachment point with bar.

BACKGROUND

Cable pulley exercise machines are a staple in most every gym. These machines require the user to attach one of many different types of handles or bars to the cable system in order to perform an exercise. Current handles/bars suffer from at least three problems. First, most handles are solid pieces of metal with zero to one moving part. This forces the user's wrists to remain nearly static relative to the handle during all movements of their exercise. Since the user's wrists naturally go through different positions and angles in different motions, current handles/bars are not ergonomic and can cause discomfort or injury. Second, there are a multitude of different types and designs of handles/bars for the cable pulley exercise machines. This can be expensive to accumulate, and in a gym setting, replace. Also, handles/bars are commonly misplaced in the gym, thereby forcing users to skip intended exercises or use the wrong handle for a particular exercise. Additionally, searching for and attaching different handles/bars to the machine is inefficient. Lastly, many exercises require the user to rotate and pivot their wrists. Doing this allows for additional elongation and contraction of muscles such as the bicep. Most, if not all, exercises cannot be properly done on a cable pulley exercise machine and require the users to switch to free weights or special and expensive machines for some of the exercises.

Thus, there is a need for an improved bar and hand grip kit that solves all of these problems.

SUMMARY

In one aspect, bar and hand grips kits for exercise equipment are disclosed that have an elongate bar having a connector defining a first eyelet protruding outward from a mid-section thereof, having a plurality of elongate slots into the bar positioned in a surface opposite the connector, and a plurality of bores oriented one each transverse to one each of the plurality of elongate slots, a left hand grip and a right hand grip each having a connector pivot protruding outward therefrom that defines a second eyelet and is shaped to be received in any of the plurality of elongate slots in the bar with the second eyelet aligned with a respective one of the plurality of bores, and a first fastener and a second fastener each repeatedly, removably receivable in any one of the plurality of bores and second eyelets. In an assembled state with the connector pivot of each of the left and right hand grips received, respectively, in a first selected slot and a second selected slot of the plurality of slots of the bar and the first fastener received in the bore oriented transverse to the first selected slot and in the second eyelet of the left hand grip and the second fastener received in the bore oriented transverse to the second selected slot and in the second eyelet of the right hand grip, wherein each of the first fastener and the second fastener defines a pivot point about which the left and right hand grips, respectively, pivot within the first selected slot and the second selected slot. Both of the left hand grip and the right hand grip are freely rotatable clockwise about a center axis of rotation and are freely rotatable about an X axis oriented transverse to the center axis of rotation.

In all embodiments, each pivot point provides a range of motion with respect to the pivot point of plus or minus 10 degrees. Each of the first fastener and the second fastener has a post receivable in any of the plurality of bores and either of the second eyelets and a head that is shaped to conform to the shape of the exterior surface of the bar. The bar is cylindrical in shape and the head of each of the first and second fasteners is arcuately shaped to partially wrap around the exterior surface of the bar.

In all embodiments, each of the left hand grip and the right hand grip can be circular grips fixedly, rotationally mounted to an arch that has the connector pivot protruding therefrom. Each circular grip has an outer annular handle portion, an inner annular handle portion seated circumferentially within the outer annular handle portion, and an annular roller bearing seated between the outer annular handle portion and the inner annular handle portion. The inner annular handle portion is defined by a front annular grip portion and a back annular grip portion that are fixedly mated to one another at axially facing surfaces. Each arch terminates at opposing ends with threaded bore holes aligned with threaded mounts on the outer annular handle portion, and threaded fasteners are seated in the threaded bore holes and threaded mounts. The front annular grip portion and the back annular grip portion are fixedly fastened to one another and define a central handle and define an annular seat for the annular roller bearing. The annular roller bearing has an inner race, an outer race, a bearing cage, and a plurality of bearings. The inner race is seated on the annular seat defined by the front and back annular grip portions.

In all embodiments, the first eyelet and each of the second eyelets are shaped to be releasably connectable to a connector of a pulley cable of an exercise machine.

In another aspect, a hand grip for connection to a cable of a pulley cable exercise machine is disclosed that has an arch having a connector protruding outward therefrom that defines an eyelet and terminating at opposing ends that each have a bore hole, an outer annular handle portion having mounts positioned and aligned one each with a bore hole in the arch for free rotation therein relative to the arch, an inner annular handle portion seated circumferentially within the outer annular handle portion, and an annular roller bearing seated between the outer annular handle portion and the inner annular handle portion. The inner annular handle portion is defined by a front annular grip portion and a back annular grip portion that are fixedly mated to one another at axially facing surfaces and collectively define a central handle grip. The inner annular handle is freely rotatable clockwise and counterclockwise about a center axis of rotation relative to the outer annular handle portion, and the inner annular handle portion rotates with the outer annular handle portion collectively relative to the arch. The hand grip has a plurality of fasteners connecting the arch to the outer annular handle, one each of the plurality of fasteners seated in a bore hole of the arch and connected to a mount of the outer annular handle portion. The front annular grip portion and the back annular grip portion define an annular seat for the annular roller bearing.

In all embodiments, the annular roller bearing has an inner race, an outer race, a bearing cage, and a plurality of bearings. The inner race is seated on the annular seat defined by the front and back annular grip portions.

BRIEF DESCRIPTION OF THE DRAWINGS

Many aspects of the disclosure can be better understood with reference to the following drawings. The components in the drawings are not necessarily to scale, emphasis instead being placed upon clearly illustrating the principles of the present system.

DETAILED DESCRIPTION

Figure 1:
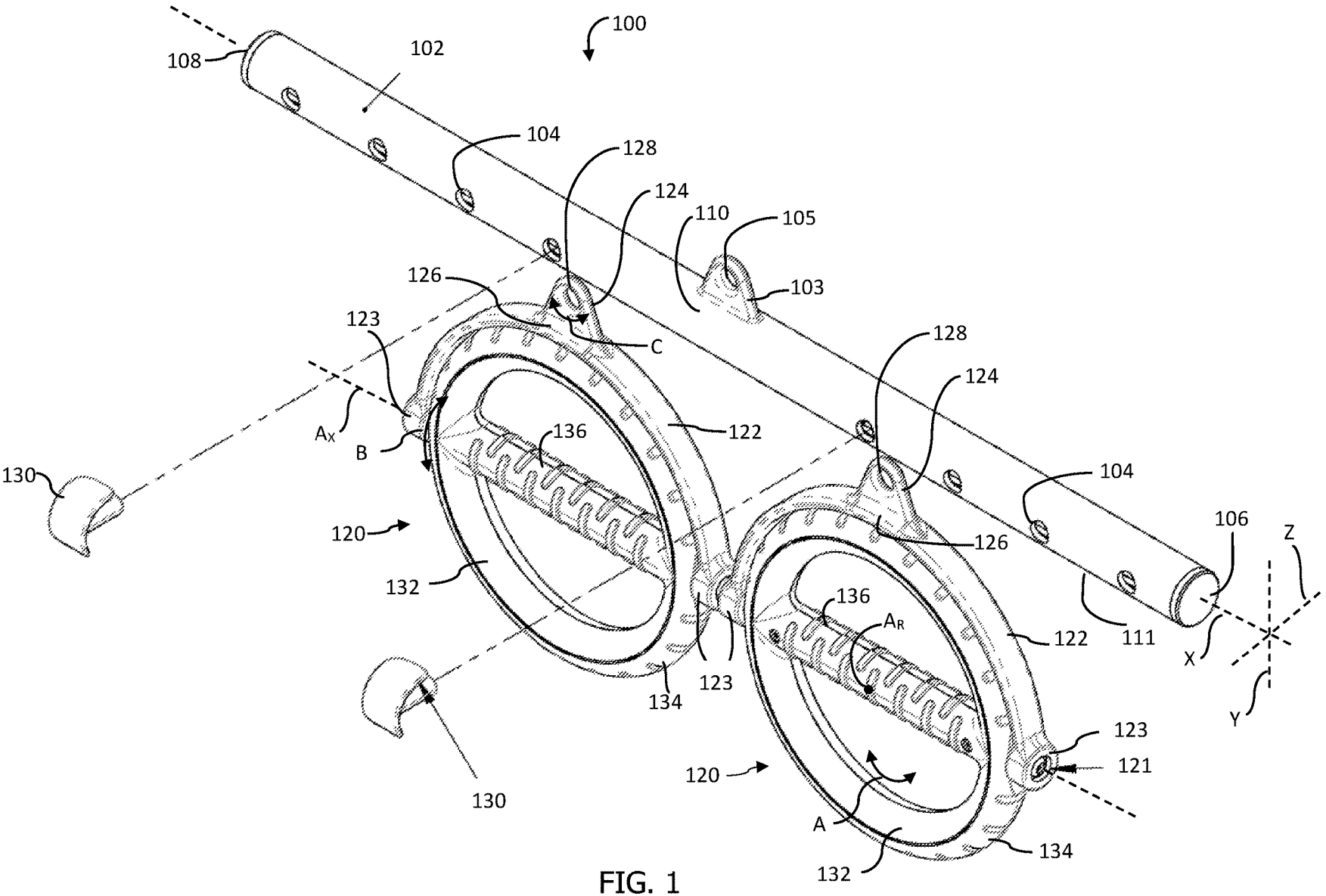
FIG. 1 is a front, perspective view of one embodiment of a kit for a cable pulley exercise machines having a bar with removably, attachable left and right hand grips.

The following detailed description will illustrate the general principles of the invention, examples of which are additionally illustrated in the accompanying drawings. In the drawings, like reference numbers indicate identical or functionally similar elements.

Figure 2:
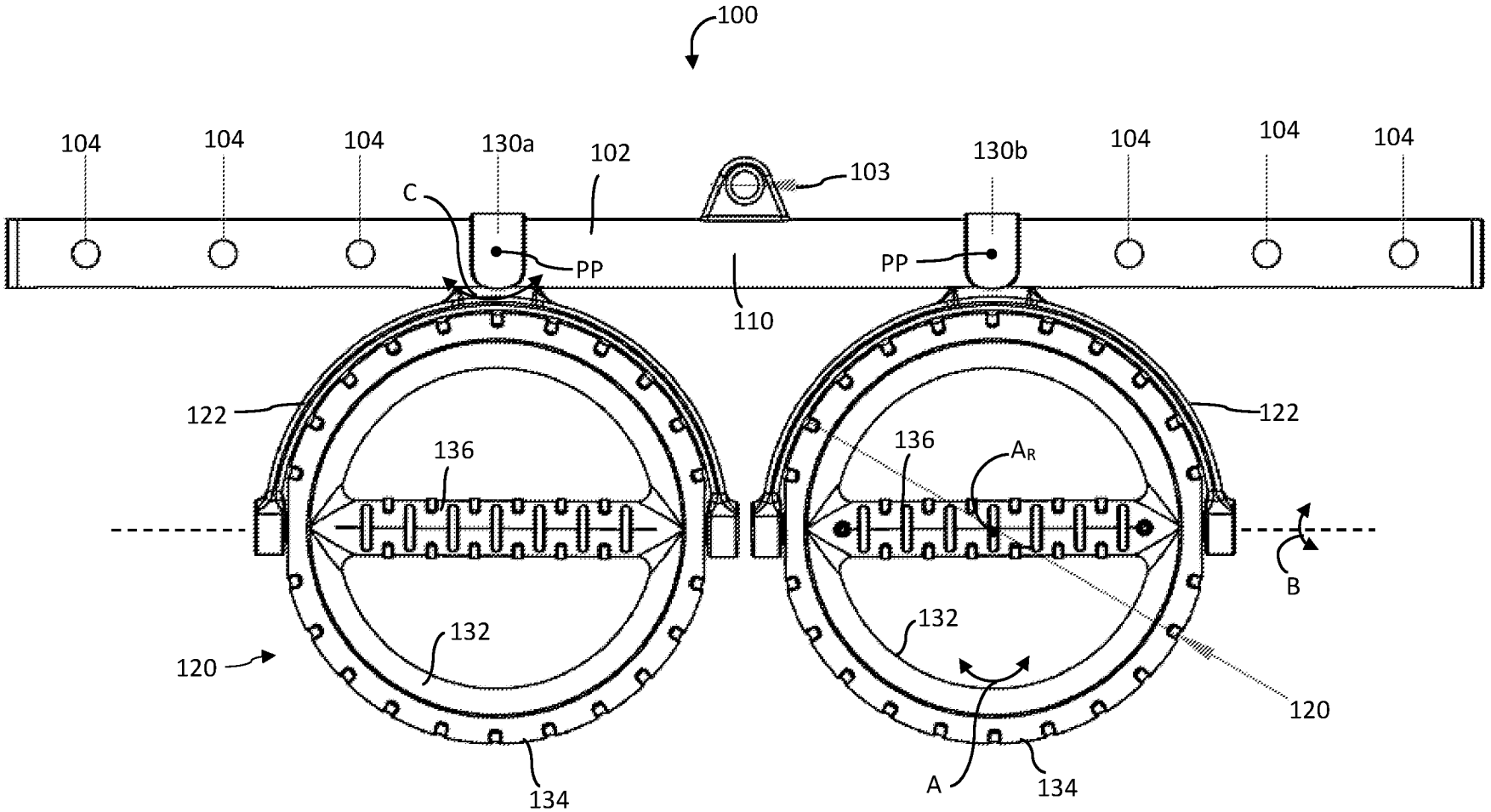
FIG. 2 is a front, plan view of the kit in an assembled state with the left and right hand grips in their respective centermost positions.
Figure 3:
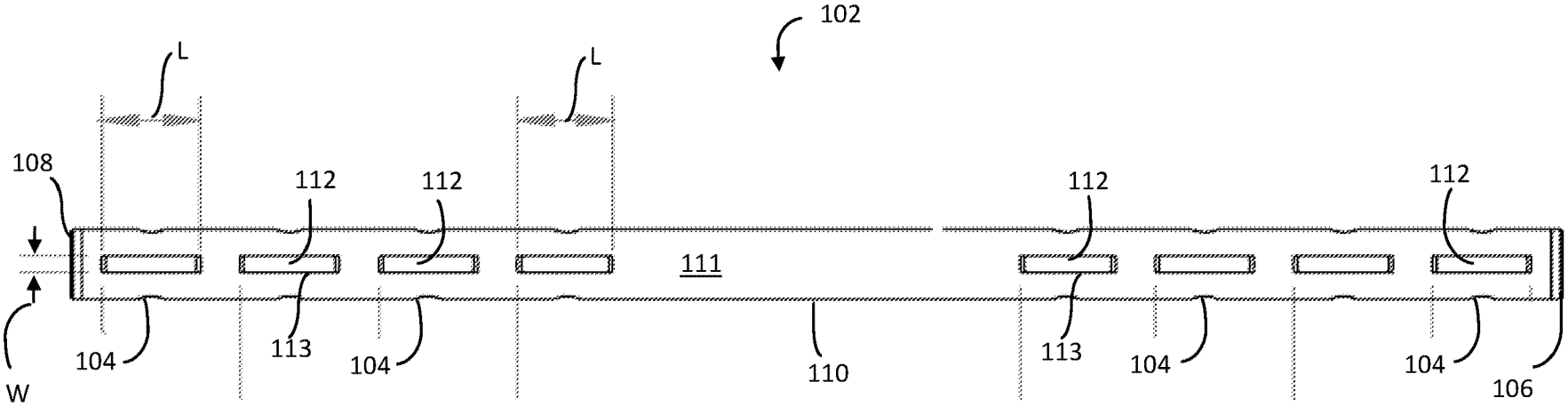
FIG. 3 is a bottom plan view of the bar.

Referring to FIGS. 1-3, a bar and hand grips kit 100 has an elongate, hollow bar 102 having a connector 103 protruding outward from a mid-section 110 thereof, at least left and right hand grips 120 and a plurality of fasteners 130. The connector 103 defines a first eyelet 105 shaped to be releasably connectable to a connector of a pulley cable of an exercise machine. The bar 102 has a plurality of transverse bores 104 set pre-selected distances apart that begin from each end 106, 108 and move toward the mid-section 110 of the bar. Also, the bar 102 has a plurality of elongate slots 112 in a surface 111 (shown in FIG. 3) opposite the connector 103. The plurality of elongate slots 112 are set a pre-selected distance apart from one another and begin from each end 106, 108 and move toward the mid-section 110 of the bar. In the embodiment, shown in FIG. 3, there are four elongate slots 112 in both ends 106, 108 of the bar 102. The bar, however, is not limited thereto. If the bar was solid, each of the plurality of elongate slots 112 would have a depth into the bar 10 sufficient for alignment with one of each of the plurality of transverse bores 104 such that a respective bore 104 transects a respective slot 112.

The kit 100 has a plurality of circular hand grips 120 each fixedly, rotationally mounted to an arch 122 by a fastener 121 at each mounting point 123. The plurality of circular hand grips, at a minimum, is a left hand grip 120 and a right hand grip 120, but the kit can have any number of such hand grips as each are interchangeable with one another. The arch 122 of each circular hand grip 120 has a connector pivot 124 protruding radially outward from an apex 126 of the arch. Each connector pivot 124 defines a second eyelet 128 axially therethrough and is shaped to be seated in any one of the plurality of elongated slots 112 with the eyelet 128 in alignment with a respective transverse bore 104 of the bar 102 and is shaped to be releasably connectable to a connector of a pulley cable of an exercise machine independent of the bar 102. The fasteners 121 can be threaded screws or bolts, fixed pins, or any other suitable fastener. Both the left hand grip 120 and the right hand grip 120 are freely rotatable clockwise/counterclockwise about a center axis of rotation ($A_R$) and are freely rotatable about an X axis oriented transverse to the axis of rotation and aligned with the central handle 138 of each of the left and right hand grips 120.

As used herein, "free rotation" or "freely rotatable" is rotation through 360 or more degrees in two opposing directions, e.g., clockwise and counterclockwise, forward and backward, etc.

Figure 5:
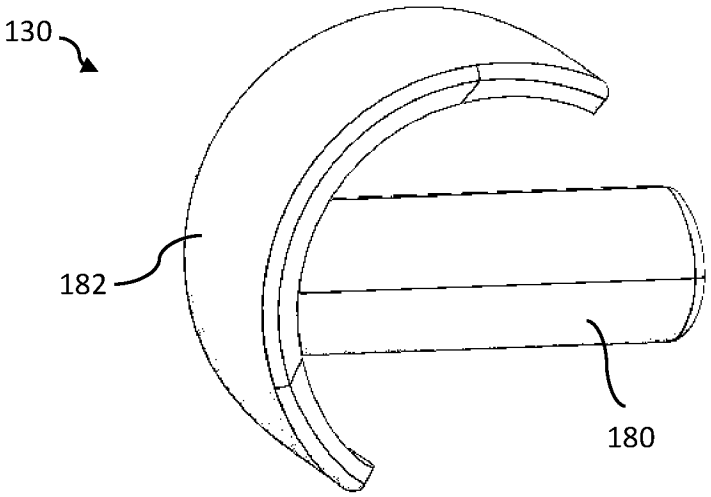
FIG. 5 is a side perspective view of one of the plurality of fasteners.

Turning to FIGS. 1, 2 and 5, the kit 100 includes a plurality of fasteners 130 repeatedly, removably receivable in any one of the plurality of transverse bores 104 and through any of the second eyelets 128 in a connector pivot 124 simultaneously to securely, replaceably mount each hand grip 120 to the bar 102. Each of the plurality of fasteners 130 has a post 180 receivable in any of the plurality of bores 104 and either of the second eyelets 128 simultaneously when the connector pivot 124 is received in one of the slots 112 in the bar. Each of the plurality of fasteners 130 has a head 182 that is shaped to conform to the shape of the exterior surface of the bar 120. In one embodiment, the bar 120 is cylindrically shaped and the head 182 of each of the plurality of fasteners 130 is arcuately shaped to partially wrap around the exterior surface of the bar 102. As shown in FIGS. 5 and 2, the arcuately shaped head 182 wraps over the top surface of the bar and covers the front face of the bar 102. The arcuately shaped head 182 may have an arcuate length of 100 degrees up to 180 degrees of a circle. In another embodiment, the bar 102 may be square or rectangular in cross-section and the head 182 of each of the plurality of fasteners 130 is shaped to mate against the exterior surface of the bar 102, thereby being generally L-shaped. Each of the plurality of fasteners 130 is rated to handle 350 pounds. In one embodiment, the fasteners 130 are made of plastic. In another embodiment, the fasteners 130 can be made of metal or a combination of metal and plastic.

As shown in FIG. 2, in the assembled state, the connector pivot 124 of each of the left and right hand grips 120 is received, respectively, in a first selected slot 112 and a second selected slot 112 of the plurality of slots of the bar 102. The connector pivot 124 is generally triangularly shaped with the base of the triangle connected to the arch 122. Here, the hand grips 120 are shown received in the centermost slots 112. The first fastener **130*a* is received in the bore 104 oriented transverse to the first selected slot 112 and in the second eyelet 128 of the left hand grip. Likewise, the second fastener 130*b* is received in the bore 104 oriented transverse to the second selected slot 112 and in the second eyelet 128 of the right hand grip 120. Each of the first fastener 130*a* and the second fastener 130*b* define a pivot point (PP) about which the left and right hand grips 120 pivot within the first selected slot 112 and the second selected slot 112, respectively. Each pivot point (PP) provides a range of motion (arrow (C)) relative thereto of up to plus or minus 10 degrees. "Plus" degrees herein is to the right in FIG. 2 and "minus" degrees is to the left in FIG. 2. Referring to FIG. 3, to accommodate the preselected degree of motion (+/−10 degrees) about each pivot point (PP), each of the plurality of slots 112 has a length (L) that is greater than the width of the connector pivot 124 at the slot mouth 113 in the bottom surface 111 of the bar 102. Each of the plurality of slots 112 has a width (W) that is wide enough to receive the connector pivot 124 of each of the hand grips 120**.

In the embodiment of FIG. 3, the spacing between the plurality of slots 112 from the first end 106 toward the midsection 110 of the bar 102 (a first set of slots) and from the second end 108 toward the midsection 110 of the bar 102 (a second set of slots) are shown to be the same as one another and have equal spacing between slots within each of the first and second set of slots. Equal spacing between the slots within each set of slots is not required. The spacing should be pre-selected based upon the handle positions needed for the different exercises to be performed by the user relative to the configuration of a selected pulley cable exercise machine.

Figure 4:
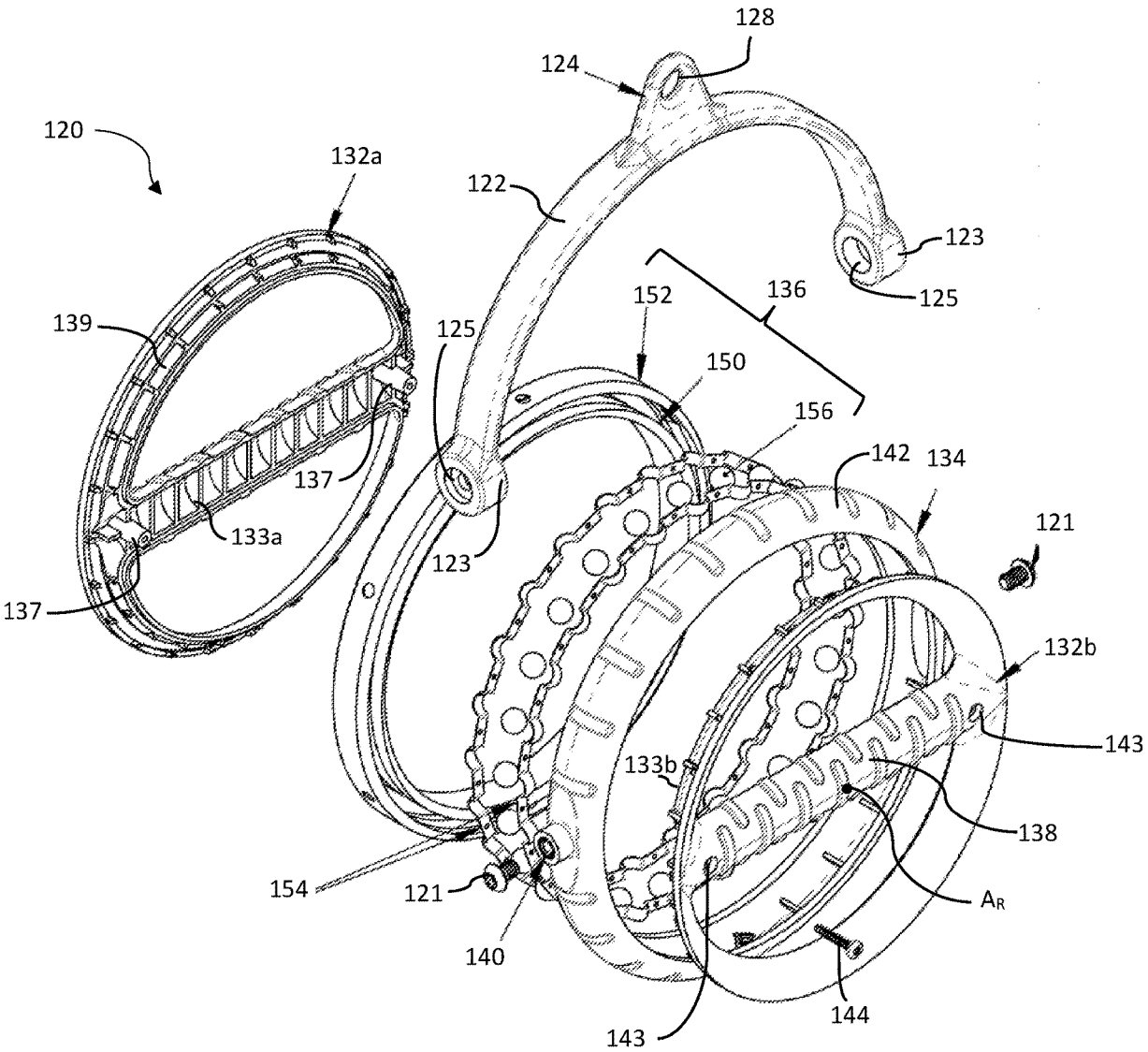
FIG. 4 is an exploded view of one of the hand grips.

Turning now to FIG. 4, each circular hand grip 120 has and arch 122 that has the connector pivot 124 described above, an outer annular handle portion 134 and an inner annular handle portion 132 seated circumferentially within the outer annular handle portion 134 with an annular roller bearing 136 seated therebetween such that the inner annular handle portion 132 is freely rotatable (clockwise and counterclockwise) about an axis of rotation ($A_R$) (best seen in FIG. 1) relative to the outer annular handle portion 134. The outer annular handle portion 132 has opposing mounts 140, which may have internal threading, protruding radially outward from an exterior surface of the ring 142. The arch 122 terminates at opposing ends with mating mounts 123 that each receive one of the opposing mounts 140 of the outer annular ring 134. The mating mounts 123 may have threaded or partially threaded bore holes 125. Here, the opposing mounts 140 are seated in the mating mounts 123, but the opposite configuration is also possible. The mated mounts and fastener 121 facilitate the free rotation of the left and right hand grips 120, respectively, relative to the arch 122 about the $A_X$ axis.

Still referring to FIG. 4, the inner annular handle portion 132 is defined by a front annular grip portion 132*a* and a back annular grip portion 132*b* that are fixedly mated to one another at axially facing interior surfaces 133*a*, 133*b*, optionally by fasteners 144 such as threaded screws, and define a central handle 138 and define an internal annular seat 139 for the annular roller bearing 136. The interior surface 133*a* of the front annular grip portion 132*a* has hollow posts 137 protruding axially toward the back annular grip portion 132*b*, which may have internal threading, for receiving a fastener 144 therein that passes through a bore 143 in the back annular grip portion 132*b*. In another embodiment, the front annular grip portion 132*a* and the back annular grip portion 132*b* may have a snap fit to one another, be adhered to one another, or welded to one another.

The annular roller bearing 136 has an inner race 150, an outer race 152, a bearing cage 154, and a plurality of balls or rollers 156. The inner race 150 is seated on the annular seat 139 defined by the front and back annular grip portions 132*a*, 132*b*. In the illustrated embodiment, the bearing cage 154 is a "J" type cage, but is not limited thereto. A "J" type cage has a two-piece ribbon consisting of two halves that are assembled one half from one side and the other half from the opposite side. Fold down tabs or rivets typically secure the two halves. This type of cage is guided by the balls. The annular roller bearing 136 facilitates the free rotation of the inner annular handle portion 132 relative to the outer annular handle portion 134.

The kit 100 is advantageous because it allows for a more natural and ergonomic range of exercise motion of the user because the hand grips rotate and pivot to accommodate the users natural motion and relieve stress on the wrists. In contrast, if a user grabs a handle consisting of two vertical, spaced-apart hand grips fixedly attached to (no rotation possible) and spaced a distance of about five inches from a connector plate with their arms fully extended to the front, and pull those handles toward their chest, the user's wrists will become more perpendicular to the forearms, thereby putting undue stress on the wrists.

Also, the bar and hand grips kit eliminates the need to buy a plurality of different handles and bars that are currently available for pulley cable exercise machines. The kit 100 is all that is needed because the myriad hand grip positions/combinations are suitable for a multitude of exercises using a pulley cable exercise machine.

It should be noted that the embodiments are not limited in their application or use to the details of construction and arrangement of parts and steps illustrated in the drawings and description. Features of the illustrative embodiments, constructions, and variants may be implemented or incorporated in other embodiments, constructions, variants, and modifications, and may be practiced or carried out in various ways. Furthermore, unless otherwise indicated, the terms and expressions employed herein have been chosen for the purpose of describing the illustrative embodiments of the present invention for the convenience of the reader and are not for the purpose of limiting the invention.

Having described the invention in detail and by reference to preferred embodiments thereof, it will be apparent that modifications and variations are possible without departing from the scope of the invention which is defined in the appended claims.

What is claimed is:

1. A bar and hand grips kit for exercise equipment comprising:

an elongate bar having a connector defining a first eyelet protruding outward from a mid-section thereof, having a plurality of elongate slots into the bar positioned in a surface opposite the connector, and a plurality of bores each one oriented transverse to each one of the pluralities of elongate slots;

a left hand grip and a right hand grip each having a connector pivot protruding outward therefrom that defines a second eyelet that is shaped to be received in any of the plurality of elongate slots in the bar with the second eyelet aligned with a respective one of the plurality of bores;

a first fastener and a second fastener each repeatedly, removably receivable in any one of the plurality of bores and second eyelets;

wherein, in an assembled state with the connector pivot of each of the left and right hand grips received, respectively, in a first selected slot and a second selected slot of the plurality of slots of the bar and the first fastener received in the respective bore oriented transverse to the first selected slot and in the second eyelet of the left hand grip and the second fastener received in the respective bore oriented transverse to the second selected slot and in the second eyelet of the right hand grip, wherein each of the first fastener and the second fastener defines a pivot point about which the left and right hand grips, respectively, pivot within the first selected slot and the second selected slot;

wherein both of the left hand grip and the right hand grip are freely rotatable clockwise about a center axis of rotation and are freely rotatable about an X axis oriented transverse to the center axis of rotation.

2. The bar and hand grips kit as claimed in claim 1, wherein each pivot point provides a range of motion with respect to the pivot point of plus or minus 10 degrees.

3. The bar and hand grips kit as claimed in claim 1, wherein each of the first fastener and the second fastener has a post receivable in any of the plurality of bores and either of the second eyelets and a head that is shaped to conform to a shape of an exterior surface of the bar.

4. The bar and hand grips kit as claimed in claim 3, wherein the bar is cylindrical in shape and the head of each of the first and second fasteners is arcuately shaped to partially wrap around the exterior surface of the bar.

5. The bar and hand grips kit as claimed in claim 1, wherein each of the left hand grip and the right hand grip are circular grips fixedly, rotationally mounted to an arch, wherein the arch has the connector pivot protruding therefrom; wherein each circular grip comprises:

an outer annular handle portion;

an inner annular handle portion seated circumferentially within the outer annular handle portion, wherein the inner annular handle portion is defined by a front annular grip portion and a back annular grip portion that are fixedly mated to one another at axially facing surfaces; and an annular roller bearing seated between the outer annular handle portion and the inner annular handle portion.

6. The bar and hand grips kit as claimed in claim 5, wherein the arch terminates at opposing ends with threaded bore holes aligned with threaded mounts on the outer annular handle portion and threaded fasteners are seated in the threaded bore holes and threaded mounts.

7. The bar and hand grips kit as claimed in claim 5, wherein the front annular grip portion and the back annular grip portion are fixedly fastened to one another and define a central handle and define an annular seat for the annular roller bearing.

8. The bar and hand grips kit as claimed in claim 7, wherein the annular roller bearing comprises an inner race, an outer race, a bearing cage, and a plurality of bearings, wherein the inner race is seated on the annular seat defined by the front and back annular grip portions.

9. The bar and hand grips kit as claimed in claim 1, wherein the first eyelet and each of the second eyelets are shaped to be releasably connectable to a connector of a pulley cable of an exercise machine.

10. A hand grip for connection to a cable of a pulley cable exercise machine comprising:

an arch having a connector protruding outward therefrom that defines an eyelet and terminating at opposing ends that each have a bore hole;

an outer annular handle portion having mounts each one positioned and aligned with a respective bore hole in the arch for free rotation therein relative to the arch;

an inner annular handle portion seated circumferentially within the outer annular handle portion, wherein the inner annular handle portion is defined by a front annular grip portion and a back annular grip portion that are fixedly mated to one another at axially facing surfaces and collectively define a central handle grip; and an annular roller bearing seated between the outer annular handle portion and the inner annular handle portion;

wherein the inner annular handle is freely rotatable clockwise and counterclockwise about a center axis of rotation relative to the outer annular handle portion;

wherein the inner annular handle portion rotates with the outer annular handle portion collectively relative to the arch; and wherein the connector is receivable in an elongate slot on an elongate bar and a first fastener is receivable in a bore on the bar oriented transverse to the slot and in the eyelet of the arch.

11. The hand grip as claimed in claim 10, comprising a plurality of fasteners connecting the arch to the outer annular handle, each one of the plurality of fasteners seated in the bore hole of the arch and connected to the mount of the outer annular handle portion.

12. The hand grip as claimed in claim 10, wherein the front annular grip portion and the back annular grip portion define an annular seat for the annular roller bearing.

13. The hand grip as claimed in claim 11, wherein the annular roller bearing comprises an inner race, an outer race, a bearing cage, and a plurality of bearings, wherein the inner race is seated on the annular seat defined by the front and back annular grip portions.

* * * * *